US007895933B2

(12) United States Patent
Quis

(10) Patent No.: US 7,895,933 B2
(45) Date of Patent: Mar. 1, 2011

(54) PISTOL CONVERSION FROM AN AUTOMATIC WEAPON

(76) Inventor: Tomas Quis, Vsetin (CZ)

( * ) Notice: Subject to any disclaimer, the term of this patent is extended or adjusted under 35 U.S.C. 154(b) by 0 days.

(21) Appl. No.: 11/783,151

(22) Filed: Apr. 6, 2007

(65) Prior Publication Data

US 2008/0086926 A1 Apr. 17, 2008

(51) Int. Cl.
*F41A 5/00* (2006.01)

(52) U.S. Cl. ..... 89/139; 89/128; 89/142; 42/70.05

(58) Field of Classification Search ..... 89/128, 89/139, 142, 148, 190; 42/70.04, 70.05, 42/70.08

See application file for complete search history.

(56) References Cited

U.S. PATENT DOCUMENTS 4,176,584 A * 12/1979 Thomas et al. ..... 89/138
6,240,670 B1 * 6/2001 Findlay ..... 42/70.08
2007/0266845 A1 * 11/2007 Polston ..... 89/139

* cited by examiner

*Primary Examiner*—Stephen M Johnson
*Assistant Examiner*—Daniel J Troy
(74) *Attorney, Agent, or Firm*—Hershkovitz & Associates, LLC.; Abraham Hershkovitz

(57) ABSTRACT

A semi-automatic pistol is created by the modification of a fully automatic sub-machine gun Sa vz. 61. The semi-automatic pistol is constructed partly from original parts of the Sa vz. 61 sub-machine gun, i.e. barrel, receiver, trigger, trigger lever and pistol grip, partly from modified parts of Sa vz. 61 sub-machine gun, i.e. hammer, interrupter and bolt, and partly from newly manufactured parts, i.e. semi-automatic frame without a groove in the bridge for the release lever and openings in rear stop for retarder assembly and without rails for folding stock on the outside of the rear wall, and a new safety lever with holes and grooves in such a positions that only semi-automatic fire is possible in its forward position. Some parts of the Sa vz. 61 sub-machine gun are removed completely, i.e. original frame, original safety lever, release lever, folding stock and retarder group (bolt hook, weight, counterweight, spring). A method of converting an automatic sub-machine gun into a semi-automatic pistol is also described.

10 Claims, 12 Drawing Sheets

PRIOR ART

PRIOR ART

PRIOR ART

PRIOR ART

PISTOL CONVERSION FROM AN AUTOMATIC WEAPON

BACKGROUND OF THE INVENTION

1. Field of the Invention

The invention relates to firearms, and specifically to guns similar to military weapons, but modified to be appropriate for civilian, sporting use. This particular invention converts the Czech model Sa vz. 61 submachine gun to a semi-automatic pistol.

2. Discussion of Background Information

An interest exists in collecting and shooting firearms, which have been developed for military purposes and are used by government armed forces. This interest is shared by many civilians. But because most of these weapons have features typical of military weapons, ownership of these guns is strongly restricted and is reserved only to a small number of authorized enthusiasts. On the other hand, weapons without military features are not subject to such restrictions and can be owned, used and transferred among private individuals. Pistols particularly, do not have features typical of military submachine guns, such as fully automatic fire and a military style folding stock.

SUMMARY OF THE INVENTION

According to an aspect of the present invention, a military automatic weapon is converted into a semi-automatic sporting weapon that is incapable of being easily re-configured to its original purpose. Specifically, a Czech model Sa vz 61 fully automatic submachine gun is modified to be only a semi-automatic weapon, incapable of reverting to a fully automatic use. The converted weapon is referred to throughout this application as the Sa vz. 61 pistol.

The semi-automatic Sa vz. 61 pistol is made partly from the original parts of an Sa vz. 61 submachine gun, partly from modified parts of an Sa vz. 61 submachine gun, and some new parts, while removing some parts completely. The parts that remain unchanged, include the barrel, receiver, trigger, trigger lever, insert lever and pistol grip.

According to an aspect of the invention, the modified parts include the hammer, interrupter and bolt. The hammer is modified by removing the cog on the right hand side, which operates against the groove of the release lever during fully automatic fire. The original interrupter has a rear arm cut off, so that in case of a potential attempt to weld (fill in) the middle groove of the original safety lever, the interrupter is not put out of function and the gun's semi-auto only mode of fire is still secured. The bolt is modified by grinding off the projection in the rear part of its right hand side groove on the lower side of the bolt in order to eliminate its co-operation with the release lever in the case of a potential attempt to re-install the release lever.

According to another aspect of the invention, new parts are made to replace the parts of the automatic sub-machine gun. A new semi-automatic frame is made without the original groove for the release lever and openings for fixing the retarder assembly. On the outside, the new frame lacks the rails for attaching the folding stock. The new frame also has a larger (by 1 mm) diameter hole for a larger diameter cylindrical safety lever, so as to prevent re-installation of the original full-auto safety lever from the original Sa vz. 61 submachine gun with a proper fit.

Another part newly manufactured is the safety lever, which is made with grooves and a hole in such a way that it is only a two position safety with the forward position being for fire (and the rear position being safe) and with a groove in the middle in the case of a potential attempt to weld the rear arm of the interrupter back on.

According to an aspect of the invention, the following original Sa vz. 61 submachine gun parts are completely removed: original frame, original safety lever, release lever and retarder group (bolt hook, weight, counterweight, spring) and folding stock.

All three areas of modification, the inclusion of newly manufactured specially designed parts, the modification of some original parts, and the removal of other parts of the original Sa vz. 61 submachine gun, will eliminate the main features of this fully automatic weapon. The new semi-automatic pistol will enable enthusiasts, to legally acquire such a modified weapon for sporting and collecting purposes.

In particular the conversion provides a safety lever and frame for a semi automatic weapon where the frame comprises a right hand side wall, a left hand side wall, a rear wall and a bridge interconnecting the right and left hand walls. The frame also has a hole in at least one of the right and left hand side walls. A safety lever including a cylindrical part having an axis, and a lever part extending generally at an angle to the axis is received in the hole of the frame with the cylindrical part extending transversely across the frame.

The cylindrical part includes a single groove extending inwardly from the outer peripheral surface of the cylindrical part and along its circumference adjacent one of its axial ends, to provide a single flat bottom surface, and a single generally circular opening adjacent the other of its axial ends extending inwardly of the cylinder outer surface. In a particular embodiment, the hole in the frame and the cylindrical part of the safety lever have a diameter between generally 8.1 and 11 mm.

The cylindrical part of the safety lever includes a middle groove intermediate the single groove and the opening, which opens outwardly from the interior of the cylindrical part in the same direction as the groove and the opening.

The bridge of the frame includes a horizontally, generally planar surface which is continuous and uninterrupted. Additionally, the frame includes a rear stop adjacent a rear wall that extends between its right and left sidewalls. The rear stop is monolithic and imperforated. The rear wall has a planar rear surface that is smooth, continuous and uninterrupted.

After conversion, the semi automatic pistol has a hammer with right and left surfaces that are smooth and planar. The interrupter is a pivotal lever having a single arm. The bolt extends longitudinally of the frame and has an undersurface with two longitudinally extending grooves. The right hand side groove is continuous, without interruption or obstruction.

According to a further aspect of the invention, a method of converting a submachine gun into a pistol is provided, wherein the submachine gun includes a frame, bolt received therein, return springs, barrel, retarder group (including a bolt hook, weight, counterweight and spring), safety, trigger, an interrupter, hammer, and release lever. The submachine gun further has a frame with a bridge including a slot to co-operate with a release lever, hammer with a cog that works against the groove in the release lever during full-auto fire, interrupter with a rear arm, which during full-auto fire pushes against the safety lever and keeps the interrupter out of the function. The conversion occurs by modifying the hammer, interrupter and bolt by removing a cog from a right hand side of the hammer, removing or cutting off the rear arm of the interrupter and removing or grinding of the projection in the rear part of the right hand side groove on the lower side of the bolt. Further, a method of conversion occurs by making a frame without a slot for the release lever, without openings for fixing the retarder assembly, without a rail for a folding stock and with an opening for the safety lever larger by 1 mm, and by making a new semi-automatic only safety lever. Finally, the method comprises removal of the original frame, original safety lever, release lever, retarder group and folding stock.

The method makes a new frame with a continuous uninterrupted bridge having no slot for a release lever. The release lever and the sub-machine gun frame are removed and discarded. The method continues by replacing the sub-machine gun frame with the new frame having no slot, modifying the hammer by removing the cog on its right hand side, modifying the interrupter by cutting off its rear arm, and modifying the bolt by grinding off the projection in the rear part of right hand side groove on the lower side of the bolt, such that the converted gun is incapable of automatic fire.

After making a new safety lever which has a diameter of its cylindrical part generally between 8.1 and 11 mm and forming on the new frame a hole with a corresponding diameter, the sub-machine gun safety lever is removed and the new safety lever is fitted in the hole of the new frame.

The new safety lever is formed with only one groove on the left hand side of its cylindrical part and only one opening on the right hand side of its cylindrical part. A middle groove is formed on the cylindrical part that opens outwardly from the interior in the same direction as the groove and the opening. The middle groove is located 90° around the lengthwise axis of the cylindrical part as compared to the middle groove of the sub-machine gun safety lever.

Particularly to effect the conversion to a pistol, the submachine gun frame, the retarder group, including the bolt hook, weight, counterweight and spring, the folding stock, the release lever, the original fully-automatic safety lever, are removed and discarded. A new frame is made with a rear stop that is monolithic and imperforated, and a rear wall that is smooth and planar. The new frame is installed, whereby the conversion results in a pistol.

According to one aspect of the invention, a semi-automatic pistol is provided, comprising a barrel, a receiver, a trigger, a trigger lever, a pistol grip, a frame having, right and left hand side walls and a bridge extending between the side walls and having a generally planar upper surface that is continuous and uninterrupted, and a hole in at least one of the right and left hand side walls. The frame further includes a rear stop adjacent a rear wall which extends between the right and left sidewalls, the rear stop being monolithic and imperforated, the rear wall having a planar rear surface that is smooth, continuous and uninterrupted.

According to other aspects of the invention, there is provided a safety lever comprising a cylindrical part having an axis, and a lever part extending generally at an angle to the axis. The cylindrical part is received in the hole to extend transversely across the frame. The cylindrical part includes a single groove extending inwardly from an outer peripheral surface of the cylindrical part and along its circumference adjacent to one of its axial ends, to provide a single flat bottom surface, and a single generally circular opening adjacent to the other of its axial ends extending inwardly of a cylinder outer surface of the cylindrical part.

According to another aspect of the invention, a method of converting an automatic sub-machine gun into a semi-automatic pistol, is provided, the sub-machine gun including a bolt received therein, the bolt having a projection in the rear part of a right hand side groove on the lower side of the bolt, an interrupter having a forward arm and a rear arm, a hammer with a cog on its right hand side, a frame having a bridge including a slot to cooperate with a release lever and a safety lever with two grooves on its left hand side, two openings on the right hand side, and a middle groove. The frame further comprises a rear stop and a rear wall traversing across a right and a left side wall, the rear stop having holes therein and the rear wall including rails, the rails receiving a folding stock and the rear stop holes receiving a retarder group. The method comprises making a new frame with a continuous uninterrupted bridge having no slot for a release lever, removing and discarding the release lever and the sub-machine gun frame, replacing the sub-machine gun frame with the new frame having no slot, modifying the hammer by removing the cog on its right hand side, modifying the interrupter by cutting off its rear arm, and modifying the bolt by grinding off the projection in the rear part of the right hand side groove on the lower side of the bolt, whereby the converted gun is incapable of automatic fire.

According to further aspects of the invention, the method comprises forming on the new frame a hole with a diameter of generally between 8.1 and 11 mm, removing the sub-machine gun safety lever, making a new safety lever which has a diameter of its cylindrical part generally between 8.1 and 11 mm, and fitting the new safety lever in the hole in the new frame. The method further comprises removing and discarding the submachine gun frame, the retarder group, including a bolt hook, a weight, a counterweight and a spring, and the folding stock, making a new frame with a rear stop which is monolithic and imperforated, and a rear wall which is smooth and planar, and installing the new frame. Making the new safety lever comprises forming only one groove on the left hand side of its cylindrical part and forming only one opening on the right hand side of its cylindrical part, whereby the conversion results in a pistol and the pistol is incapable of automatic fire.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

This invention relates to the conversion of a known Sa vz 61 submachine gun to a semi automatic pistol that is acceptable for non-military users. FIGS. 9-16 depict the known Sa vz 61 submachine gun and certain of its internal parts. These figures are provided to enable a comparison with the modified and newly made parts of the Sa vz 61 pistol of the invention. The elements in the prior art figures and the corresponding elements in the invention, which are shown in FIGS. 1-8, have been identified using the same reference numbers, but distinguishing the known elements by a prime mark. A better understanding of the pistol, described below with reference to FIGS. 1-8, may be had by reference to the prior art submachine gun of FIGS. 9-16.

Figure 8:
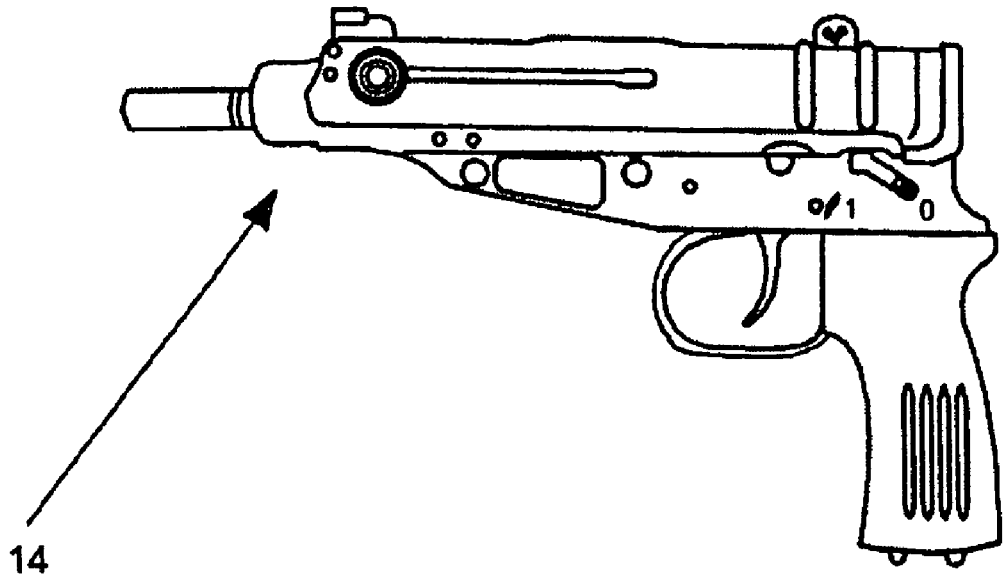
FIG. 8 is an overall side view of the semi automatic pistol Sa vz 61.
Figure 9:
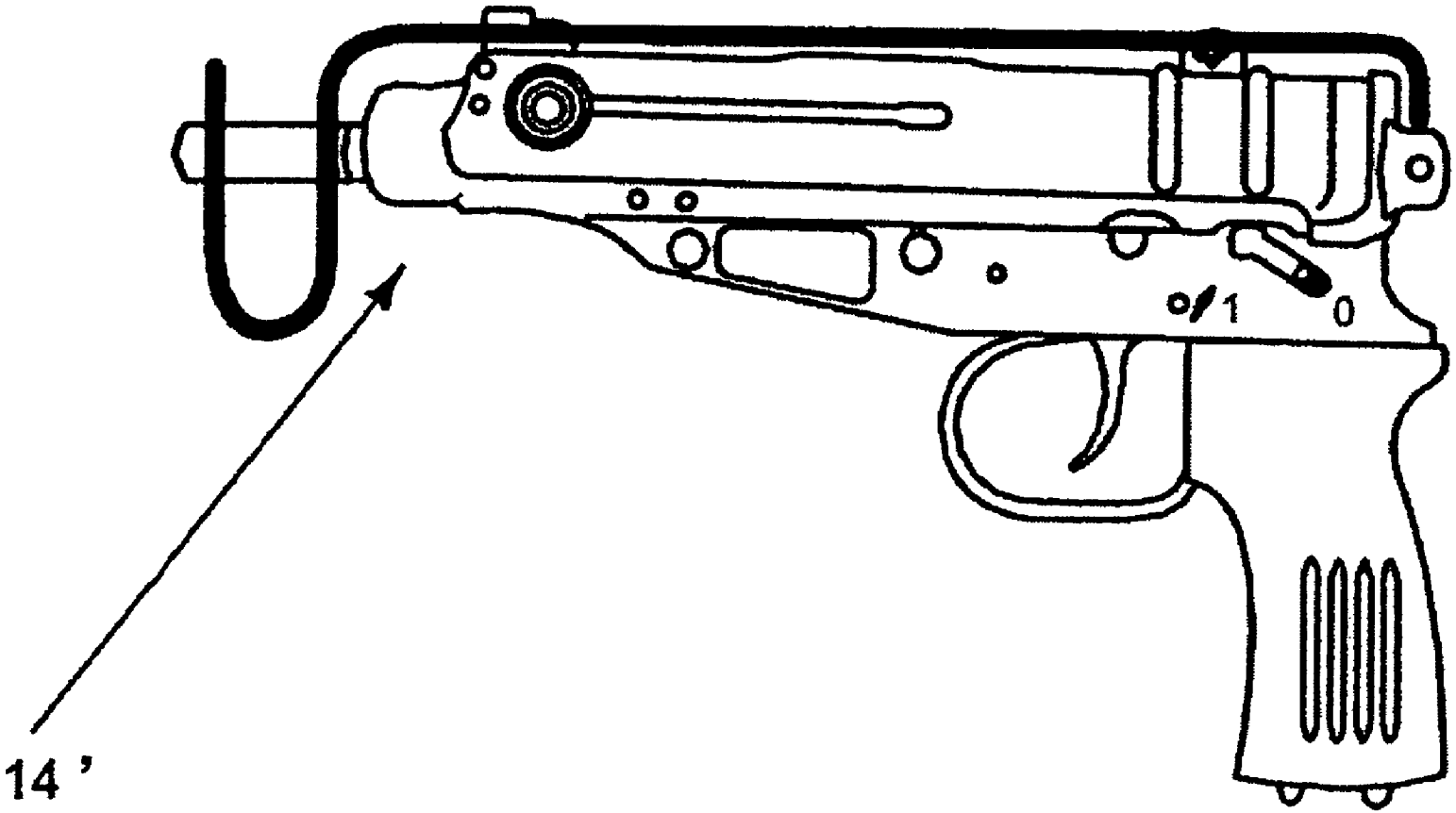
FIG. 9 is an overall side view of a known Sa vz. 61 submachine gun.

As can be seen in FIG. 8, the converted semi-automatic pistol 14 retains the original appearance of an Sa vz. 61 military sub-machine gun, but has been created partly from original parts of an Sa vz. 61 sub-machine gun, partly from modified parts, and partly from newly manufactured parts. Some parts of the Sa vz. 61 sub-machine gun are removed completely. The specific parts are listed below by category.

The parts, which remain unchanged, include:

the barrel;

the receiver;

the trigger;

the trigger lever;

the insert lever; and the pistol grip.

The following parts are modified:

the hammer 10;

the interrupter 11; and the bolt 12.

Newly manufactured parts include:

the frame 1; and the safety lever 6.

At least one of the following parts can be removed:

the submachine gun frame;

the retarder group, including the bolt hook, weight, counterweight and spring;

the release lever;

the original fully-automatic safety lever; and the folding stock.

Figure 4:
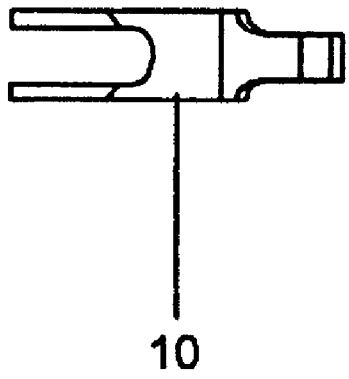
FIG. 4. is a top view of the modified hammer.

As shown in FIG. 4, the hammer 10 is modified by removing the cog 20 (FIG. 13) on the right hand side, which would operate against a groove of a release lever during fully automatic fire.

Figure 5:
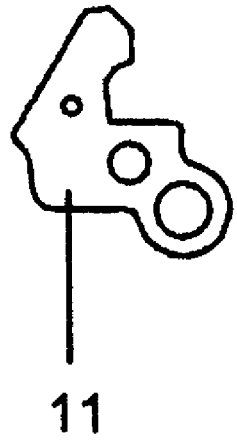
FIG. 5 is a side view of the interrupter.
Figure 6:
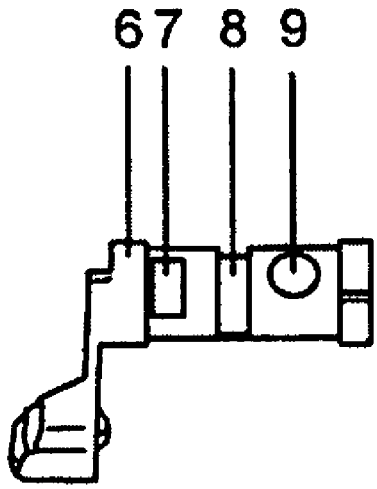
FIG. 6 is a rear view of the safety catch in a safe position.
Figure 7:
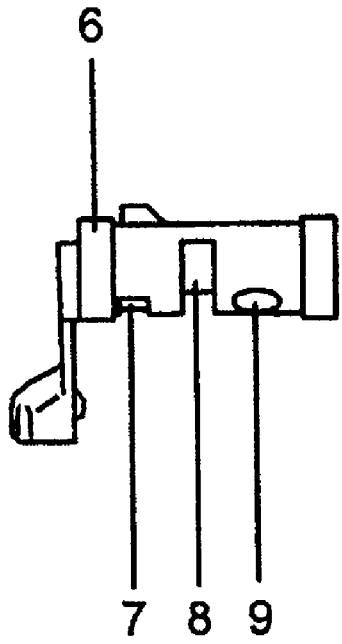
FIG. 7 is a rear view of the safety catch in a firing position.

Interrupter 11, shown in FIG. 5, has its rear arm 22 (FIG. 14) cut off, so in a case of a potential attempt to weld (fill in) the middle groove of the original safety lever, the interrupter is not put out of the function and the semi-auto only mode of fire is still ensured.

Figure 3:
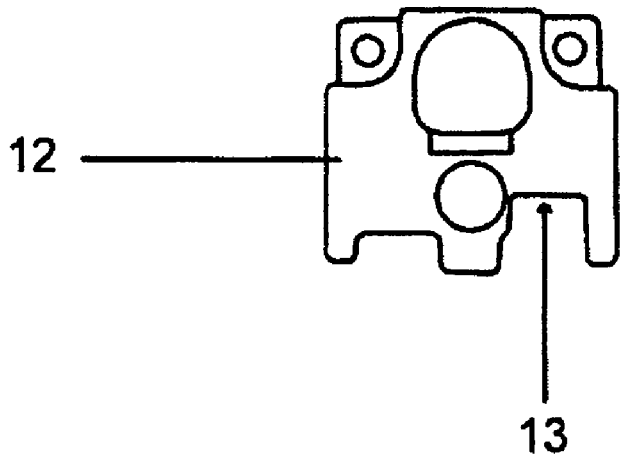
FIG. 3 is a rear view of the modified bolt.
Figure 12:
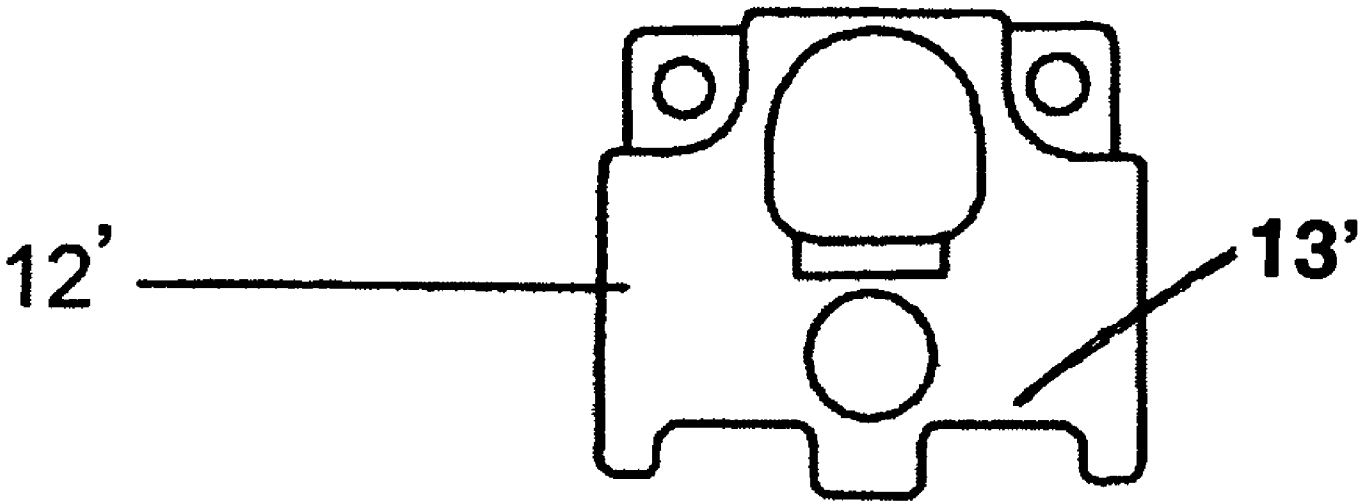
FIG. 12 is a rear view of the known submachine gun bolt.
Figure 13:
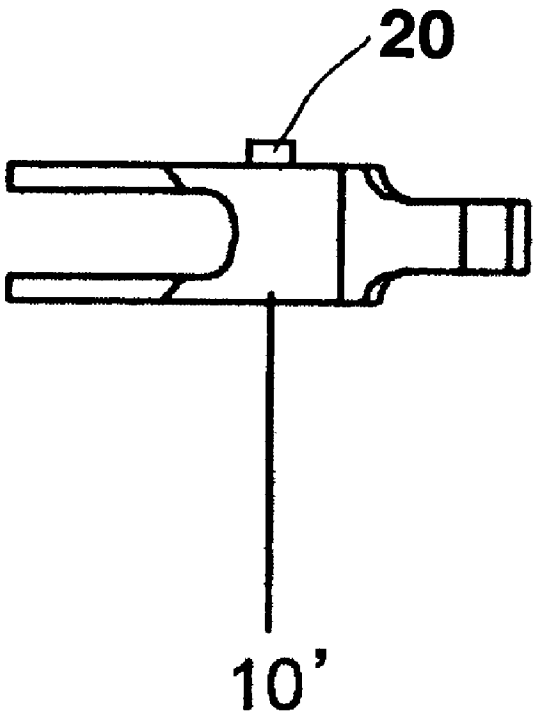
FIG. 13. is a top view of the known submachine gun hammer.
Figure 14:
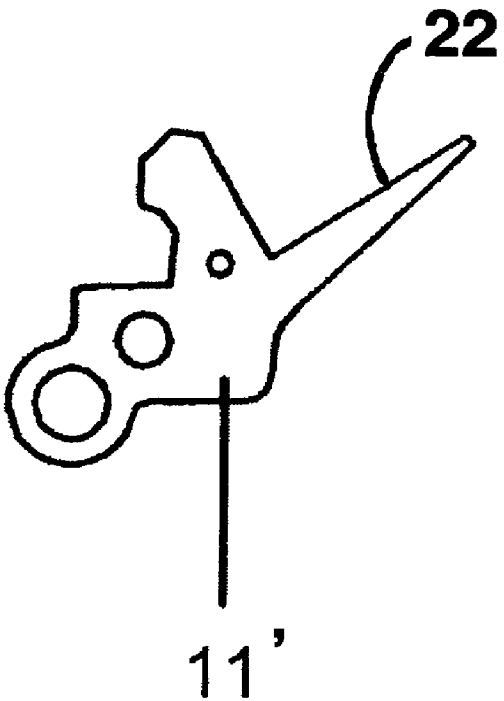
FIG. 14 is a side view of the known submachine gun interrupter.

The bolt 12, as shown in FIG. 3, is modified by grinding off the projection in the rear part of right hand side groove 13 on the lower side of the bolt in order to eliminate its co-operation with a release lever in the case of an attempt to re-install the release lever. FIG. 12 shows the projection in place in the groove 13' for the original bolt.

Figure 1:
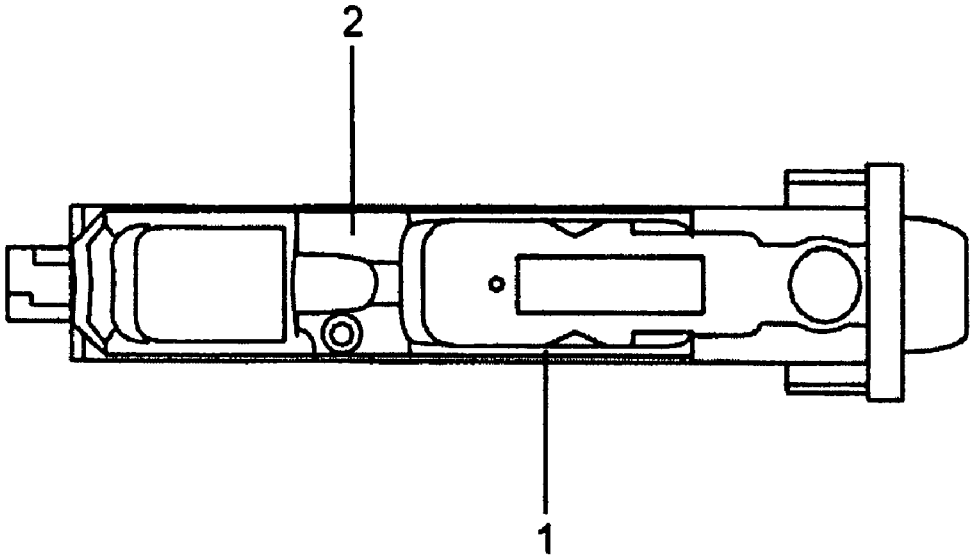
FIG. 1 is a top view of a semi-automatic frame.
Figure 2:
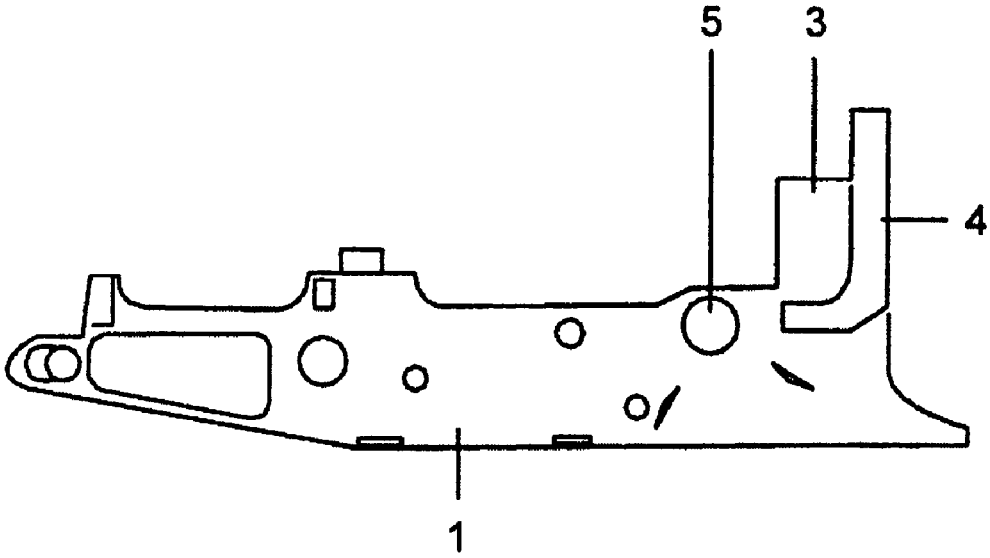
FIG. 2 is a side view of a semi-automatic frame.
Figure 10:
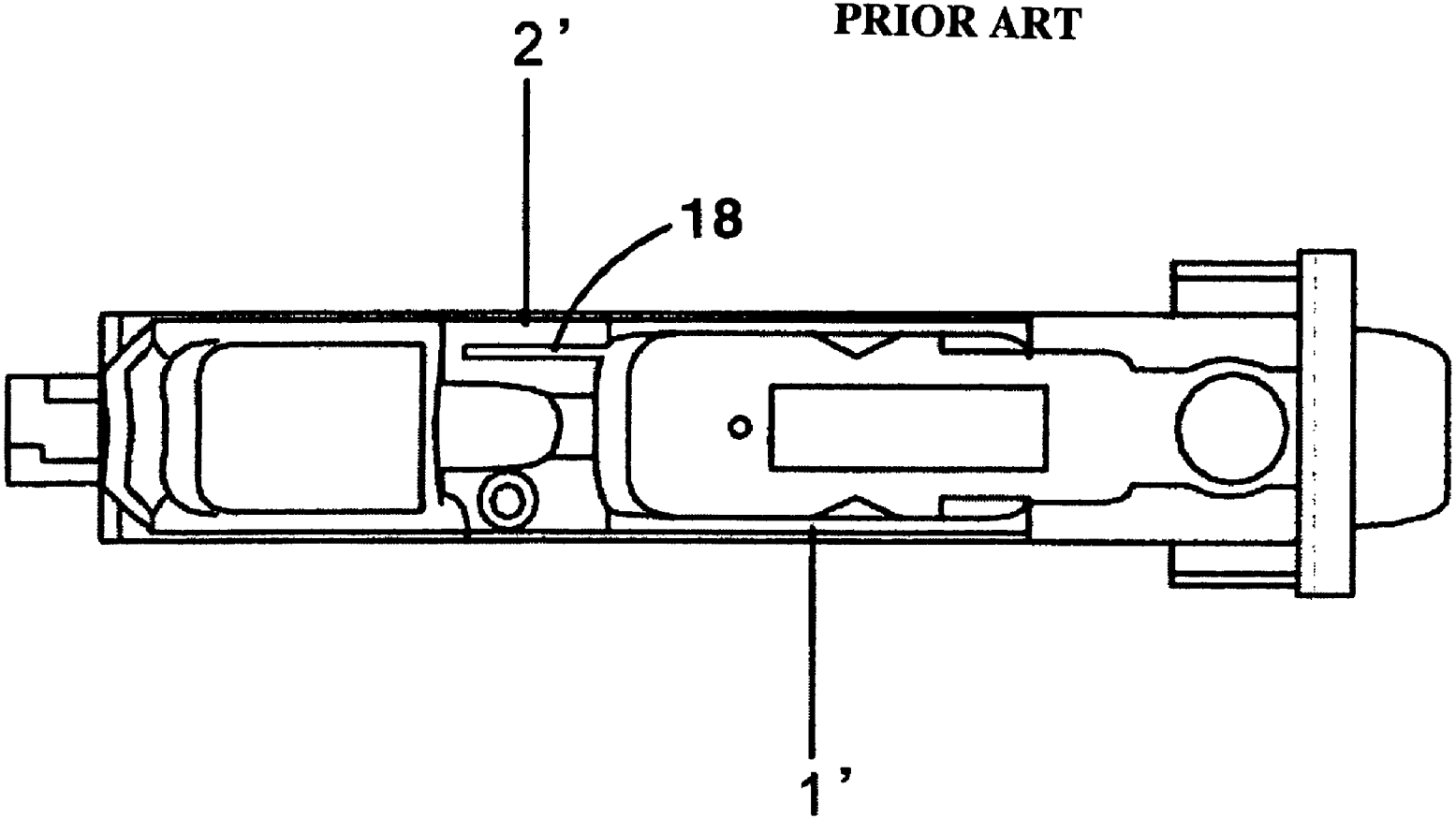
FIG. 10 is a top view of the known submachine gun frame.
Figure 11:
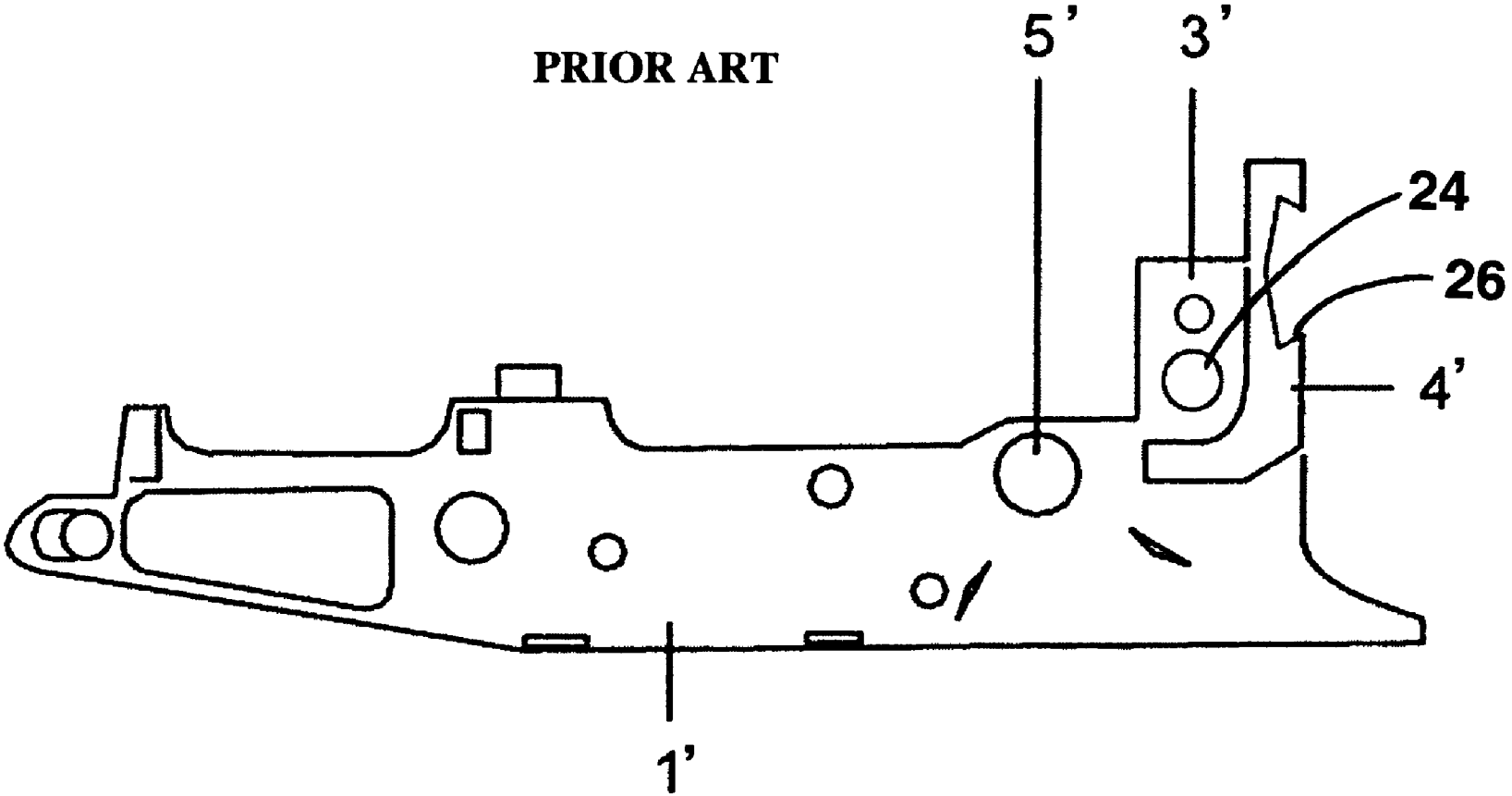
PRIOR ART Fig.11
FIG. 11 is a side view of the known submachine gun frame.

The frame 1' and the bridge 2' of the submachine gun are shown in FIG. 10. The frame includes right and left side walls and a rear wall 4. Spanning the left and right side walls, the bridge 2' includes a slot 18 for a release lever. As shown in FIG. 1, the semi-automatic pistol frame 1 has a bridge 2 that has a generally planar upper surface made without such a slot. Also, as seen in FIG. 2, the new frame 1 (FIG. 2), has a hole 5 for safety lever 6 whose diameter is larger than the hole for the safety in the Sa vz 61 submachine gun frame by about 1 mm. There are no openings in the monolithic rear stop 3 for attaching the retarder as well as no rails for the folding stock on the outside of the rear wall 4. FIG. 11 shows the retarder openings 24 and the folding stock rails 26 provided on the submachine gun frame.

Figure 15:
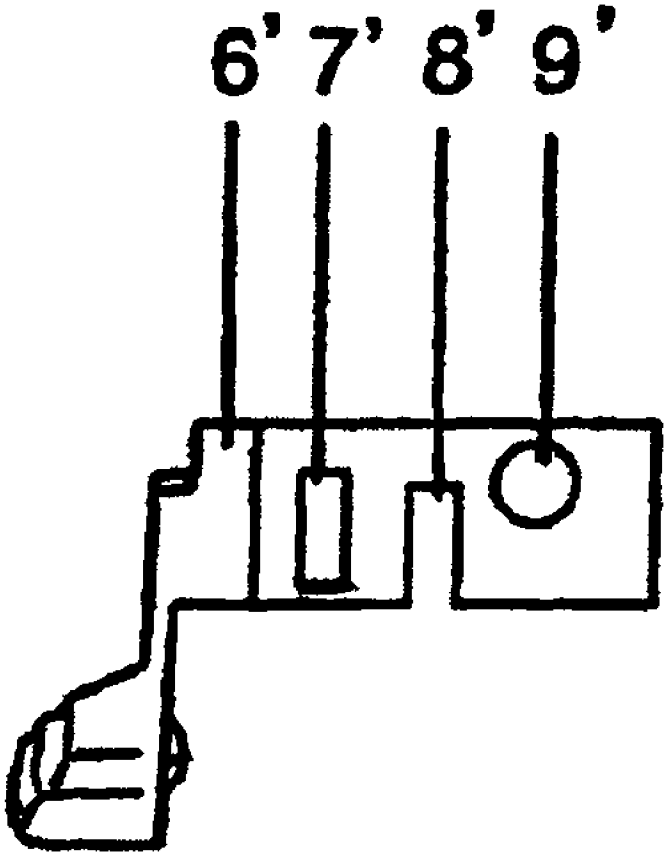
PRIOR ART Fig. 15
FIG. 15 is a rear view of the safety catch of the known submachine gun in a safe position.
Figure 16:
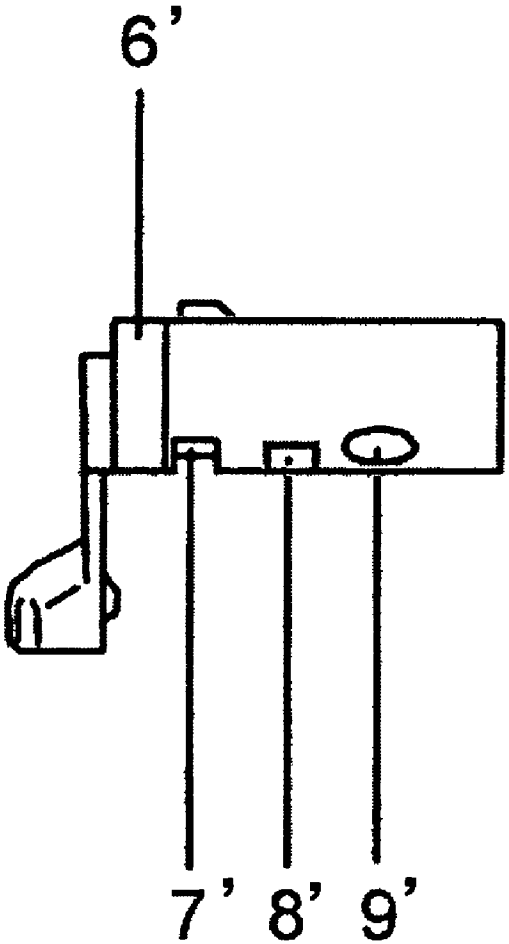
PRIOR ART Fig. 16
FIG. 16 is a rear view of the safety catch of the known submachine gun in a firing position.

Newly manufactured safety lever 6 (FIGS. 6 and 7) is made in such a way, that it is only a two position safety (safe-fire), with the fire position allowing only semi-automatic firing. This is achieved by two features that are not included in the original safety. First, on the left hand side (in a direction of fire) of the cylindrical part of the safety 6, there is only one groove 7 to receive the insert lever, unlike in the original Sa vz. 61 sub-machine gun safety, where there are two grooves 7'. As can be seen in FIGS. 15 and 16, the two grooves 7', only one of which can be seen in the figures. The single groove 7 of the new safety includes a bottom surface that is flat and continuous, extending on a chord through the cylindrical part. This one groove 7, together with other features, secures safety 6 in position for only semi-automatic mode of fire. Secondly, the function of the safety lever 6 in only two positions is ensured by making only one opening 9 in the right hand side of the cylindrical part of the safety lever 6 instead of two openings 9' as with the original safety of Sa vz. 61 submachine gun. As can be seen in FIG. 15, only one of the two openings 9' is visible. The hook of the trigger can thus fall only into one opening and thereby allow pulling of the trigger and firing only in one position of the safety—in the semi-automatic fire position.

Further, the safety lever 6 is made in such a way, that in an attempted re-installation of the original interrupter of the Sa vz. 61 sub-machine gun, the rear arm of this interrupter can not be pushed down by the cylindrical part of the safety and thus placed out of contact with the hammer to allow fully-automatic fire. This is prevented from happening by locating a middle groove 8 of the safety lever 6 at a position turned 90° around the safety axis when compared to the original safety of the Sa vz. 61 sub-machine gun. A comparison of the groove 8 location in FIGS. 6 and 7 to the grove 8' in FIGS. 15 and 16 of the submachine gun, clarifies the location difference. Thus, even if an original interrupter is attempted to be placed back, its rear arm will fit into this relocated groove 8 and will still be in contact with hammer 10, thus allowing only semi-automatic firing.

Safety 6 has a larger diameter to cooperate with the enlarged hole 5 in the frame 1. The cylindrical part of the new safety lever has a diameter between approximately 8.1 and 11 mm. such that the smaller diameter of the original fully automatic safety is thus impossible to re-install with an operative fit.

The semi-automatic Sa vz. 61 pistol conversion will allow a wide range of civilian users to own a pistol that is very similar to the fully automatic Sa vz. 61 sub-machine gun that can only be used by armed force members. Of course, the conversion is not limited to only Czech model Sa vz 61 submachine guns. The same or similar modification of some parts and the use of some new parts can convert other submachine guns to semi-automatic weapons.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS USED IN THE DRAWINGS

1,1'—frame;
2,2'—bridge;
3,3'—rear stop;
4,4'—rear wall;
5,5'—opening for safety lever;
6,6'—safety lever;
7,7'—groove on the safety lever for securing firing position
8,8'—groove for rear arm of interrupter;
9,9'—opening for the trigger hook
10,10'—hammer;
11,11'—interrupter;
12,12'—bolt;
13,13'—right hand side groove of the bolt;
14—Sa vz. 61 pistol
14'—Sa vz. 61 submachine gun
18—slot on the bridge of the frame
20—cog on hammer
22—rear arm of interrupter
24—opening in rear stop
26—rails for folding stock

What is claimed:

1. A semi-automatic pistol comprising a barrel, receiver, trigger, trigger lever and pistol grip, and further comprising:

a frame having right and left hand side walls and a bridge extending between said side walls and having a generally planar upper surface that is continuous and uninterrupted on the right hand side of said bridge in the direction of fire, and a hole in at least one of said right and left hand side walls;

said frame further including a rear stop adjacent a rear wall which extends between said right and left sidewalls, said rear stop being monolithic and imperforated, said rear wall having a planar rear surface extending from the top of the frame, most of the way towards the bottom of the frame, that is smooth, continuous and uninterrupted.

2. The semi-automatic pistol as in claim 1, further comprising a safety lever, a hammer, an interrupter, and a bolt, and wherein, said safety lever comprises a cylindrical part having an axis, and a lever part extending generally at an angle to said axis, said cylindrical part being received in said hole to extend transversely across said frame, and wherein said cylindrical part includes a single groove extending inwardly from an outer peripheral surface of the cylindrical part and along its circumference adjacent to one of its axial ends, said cylindrical part having an uninterrupted flat bottom surface throughout the entire bottom surface, and a single generally circular opening adjacent to the other of its axial ends extending inwardly of a cylinder outer surface of said cylindrical part.

3. The semi-automatic pistol as defined in claim 2, wherein said cylindrical part of said safety lever has a diameter generally between 8.1 and 11 mm.

4. The semi-automatic pistol as defined in claim 2, wherein said cylindrical part further includes a middle groove intermediate to said single groove and said opening, said middle groove opening outwardly from an interior of said cylindrical part in the same direction as said single groove and said opening.

5. The semi automatic pistol as in claim 2, wherein said hammer includes a right and left side surface, each of said entire right and left hammer side surfaces being smooth and planar.

6. The semi-automatic pistol as in claim 2, wherein said interrupter is a pivotal lever having a single arm.

7. The semi-automatic pistol as in claim 2, wherein said bolt extends longitudinally of the frame and has an undersurface, the undersurface having two longitudinally extending grooves, and wherein one of the longitudinally extending grooves is on the right hand side, continuous, and deeper than the other of the longitudinally extending grooves on the left hand side, without interruption or obstruction.

8. A semi-automatic pistol comprising:

a barrel;

a receiver;

a trigger;

a trigger lever;

a pistol grip;

a frame having, right and left hand side walls and a bridge extending between said side walls and having a generally planar upper surface that is continuous and uninterrupted on the right hand side of said bridge in the direction of fire, and a hole in at least one of said right and left hand side walls;

said frame further including a rear stop adjacent a rear wall which extends between said right and left sidewalls, said rear stop being monolithic and imperforated, said rear wall having a planar rear surface extending from the top of the frame, most of the way towards the bottom of the frame, that is smooth, continuous and uninterrupted;

a safety lever comprising a cylindrical part having an axis, and a lever part extending generally at an angle to said axis;

said cylindrical part being received in said hole to extend transversely across said frame;

said cylindrical part including a single groove extending inwardly from an outer peripheral surface of the cylindrical part and along its circumference adjacent to one of its axial ends, said cylindrical part having an uninterrupted flat bottom surface throughout the entire bottom surface, and a single generally circular opening adjacent to the other of its axial ends extending inwardly of a cylinder outer surface of said cylindrical part;

a hammer;

an interrupter; and a bolt.

9. A frame for a semiautomatic pistol comprising:

right and left hand side walls;

a bridge extending between said side walls and having a generally planar upper surface that is continuous and uninterrupted on the right hand side of said bridge in the direction of fire;

a hole in at least one of said right and left hand side walls;

a rear wall extending between said right and left sidewalls; and a rear stop ahead of said rear wall, in the direction of fire, and contiguous to said rear wall, wherein said rear stop is monolithic and imperforated and said rear wall having a planar rear surface extending from the top of the frame, most of the way towards the bottom of the frame, that is smooth, continuous and uninterrupted.

10. A frame for a semiautomatic pistol comprising:

right and left hand side walls;

a bridge extending between said side walls and having a generally planar upper surface that is continuous and uninterrupted on the right hand side of said bridge in the direction of fire;

a hole in at least one of said right and left hand side walls;

a rear wall which extending between said right and left sidewalls; and a rear stop adjacent to said rear wall, wherein said rear stop is monolithic and imperforated and said rear wall has a planar rear surface extending from the top of the frame, most of the way towards the bottom of the frame, that is smooth, continuous and uninterrupted.

* * * * *